US005483997A

United States Patent [19]

Corain et al.

[11] Patent Number: 5,483,997

[45] Date of Patent: Jan. 16, 1996

[54] BLADE TYPE WEFT BRAKE FOR A SHUTTLELESS LOOM

[75] Inventors: Luciano Corain, Vicenza; Marco Novella, Valdagno; Giulio Bortoli, Schio, all of Italy

[73] Assignee: Nuovopignone - Industrie Meccaniche e Fonderia S.p.A., Florence, Italy

[21] Appl. No.: 309,453

[22] Filed: Sep. 21, 1994

[30] Foreign Application Priority Data

Sep. 29, 1993 [IT] Italy ..... MI93A2067

[51] Int. Cl.[6] ..... B65H 59/22; D03D 47/34

[52] U.S. Cl. ..... 139/194; 242/419.3; 188/65.1

[58] Field of Search ..... 188/65.1, 65.2, 188/65.3; 139/450, 194; 242/149, 419.3, 422.2, 150 M

[56] References Cited

U.S. PATENT DOCUMENTS

| | | | |
|---|---|---|---|
| 3,129,902 | 4/1964 | Juillard . | |
| 4,641,688 | 2/1987 | Gehring | 242/149 X |
| 4,875,506 | 10/1989 | Gacsay et al. | 188/65.1 X |
| 5,305,966 | 4/1994 | Motta | 242/149 |
| 5,363,883 | 11/1994 | Weidmann | 242/149 X |

FOREIGN PATENT DOCUMENTS

| | | | |
|---|---|---|---|
| 0294323 | 12/1988 | European Pat. Off. . | |
| 0498758 | 8/1992 | European Pat. Off. . | |
| 0524429 | 1/1993 | European Pat. Off. . | |
| 1161662 | 9/1958 | France | 242/149 |
| 2597889 | 10/1987 | France . | |
| 3446567 | 5/1986 | Germany . | |
| 2039302 | 8/1980 | United Kingdom . | |
| WO89/08733 | 9/1989 | WIPO . | |

*Primary Examiner*—Andy Falik

*Attorney, Agent, or Firm*—Oblon, Spivak, McClelland, Maier & Neustadt

[57] ABSTRACT

A shuttleless loom weft brake includes at least two braking units arranged in series in the weft yarn travel direction and operating mutually out of phase. Each unit formed from a vertically arranged elastic blade at least partly of ferromagnetic material and a flat support plate of non-magnetic material, between which the weft yarn is made to travel. The blade is fixed to the frame of the weft brake by the end which is closer to the feed bobbin and is preloaded in a direction urging it away from said support plate and against a respective stop pin. The blade is pressed against the support plate by the attraction of an at least one electromagnet of adjustable excitation.

5 Claims, 2 Drawing Sheets

BLADE TYPE WEFT BRAKE FOR A SHUTTLELESS LOOM

BACKGROUND OF THE INVENTION

1. Field of the Invention

This invention relates to a new weft brake for shuttleless looms which, being self-cleaning and hence formed so as to prevent the inevitable dust and fluff produced by the weft being able to alter the set braking values, not only enables weaving to take place at a higher speed and hence with a considerable increase in productivity, but also enables better quality products to be obtained.

2. Discussion of the Background

As is well known in shuttleless loom weaving, the weft yarn provided by a feed bobbin does not always travel at a constant speed, but is subjected to acceleration and deceleration during each insertion cycle, thus requiring the use of a weft brake which allows the yarn to travel freely without braking during acceleration, but suitably brakes it during the other stages. Different types of weft brakes are already known in the state of the art, including one with electromagnetically adjusted braking action, in which the weft yarn is passed between a horizontal elastic blade, made at least partly of ferromagnetic material, and an underlying flat support plate of non-magnetic material, against which said elastic blade is suitably pressed by the attraction of at least one electromagnet of adjustable excitation.

All said known weft brakes have however the drawback of not being self-cleaning so that the yarn-generated dust and fluff which accumulate progressively between the braking members, together with the flocks of fluff which randomly come into contact with the weft yarn and are carried thereby between said braking members, create braking malfunctioning to the point of also causing stoppage of the loom and also make it necessary to manually clean the weft brake before restarting the loom.

SUMMARY OF THE INVENTION

The object of the present invention is to obviate said drawback by providing a self-cleaning weft brake which, by ensuring effective and precise braking, allows higher weaving speed and hence a considerable increase in loom productivity, and enables better quality products to be obtained.

This is substantially attained by vertically arranging the elastic blade and a respective opposing flat support plate thereof in the travelling direction of the weft yarn, to hence facilitate the escape of trash by gravity, and using on one and the same weft at least two preferably identical braking units arranged in series in the weft yarn travel direction, their operation being mutually out of phase so that by operating the brakes in different stages, at least one of the units will be inactive and remain open for the required time, while the weft yarn, by continuing to travel through its interior, is able to provide the necessary cleaning by extracting the trash.

To facilitate this latter cleaning, the elastic blades of said two braking units are rigidly fixed to the frame of the weft brake by one of the ends thereof which is closer to the feed bobbin and hence closer to the weft yarn entry, and are preloaded in a direction urging them away from their support plate and against a stop pin which is also fixed to said frame of the weft brake. In this manner, when the control electromagnet is de-energized, a constant wide aperture is ensured between the blade and plate, this evidently facilitating the extraction of trash by the travelling weft yarn or by gravity.

Hence, the shuttleless loom weft brake, comprising a braking unit arranged on the frame of the weft brake in the weft yarn travel direction and consisting of an elastic blade at least partly of ferromagnetic material, and a flat support plate of non-magnetic material, between which said weft yarn originating from a feed bobbin travels and against the plate of which said blade is adequately pressed by the attraction of at least one electromagnet of adjustable excitation, is characterized according to the present invention by using On one and the same weft at least two braking units arranged in series in said weft yarn travel direction and operating mutually out of phase, the blades and relative support plates of said braking units being arranged in a vertical position, said blades being rigidly fixed to said frame of the weft brake by the end thereof which is closer to said feed bobbin and being preloaded in a direction urging them away from their support plate and against a respective stop pin which is also fixed to said frame of the weft brake.

According to a preferred embodiment of the present invention, said support plates are made of glass.

According to a further preferred embodiment of the present invention, said support plates are of ceramic.

Finally, according to a further preferred embodiment of the present invention, said blades are preloaded in a direction urging them away from their support plate each by a column of an adjustable angular position, to which said blade is fixed, said column being rotated until the blade presses against said stop pin.

According to a modification of the present invention, in order to accelerate the withdrawal of the blades from their plates to hence achieve a higher loom speed, and to ensure stable positioning of the blades against their stop pins without deleterious vibration, the withdrawal of each preloaded blade from its support plate to rest against its stop pin is facilitated by a further electromagnet mounted on said weft brake frame in opposition to said braking control electromagnet of adjustable excitation.

BRIEF DESCRIPTION OF THE DRAWINGS

The invention is further described hereinafter with reference to the accompanying drawing, which shows a preferred embodiment thereof given by way of non-limiting example in that technical or constructional modifications can be made thereto without departing the scope of the present invention; wherein.

DESCRIPTION OF THE PREFERRED EMBODIMENTS

Figure 1:
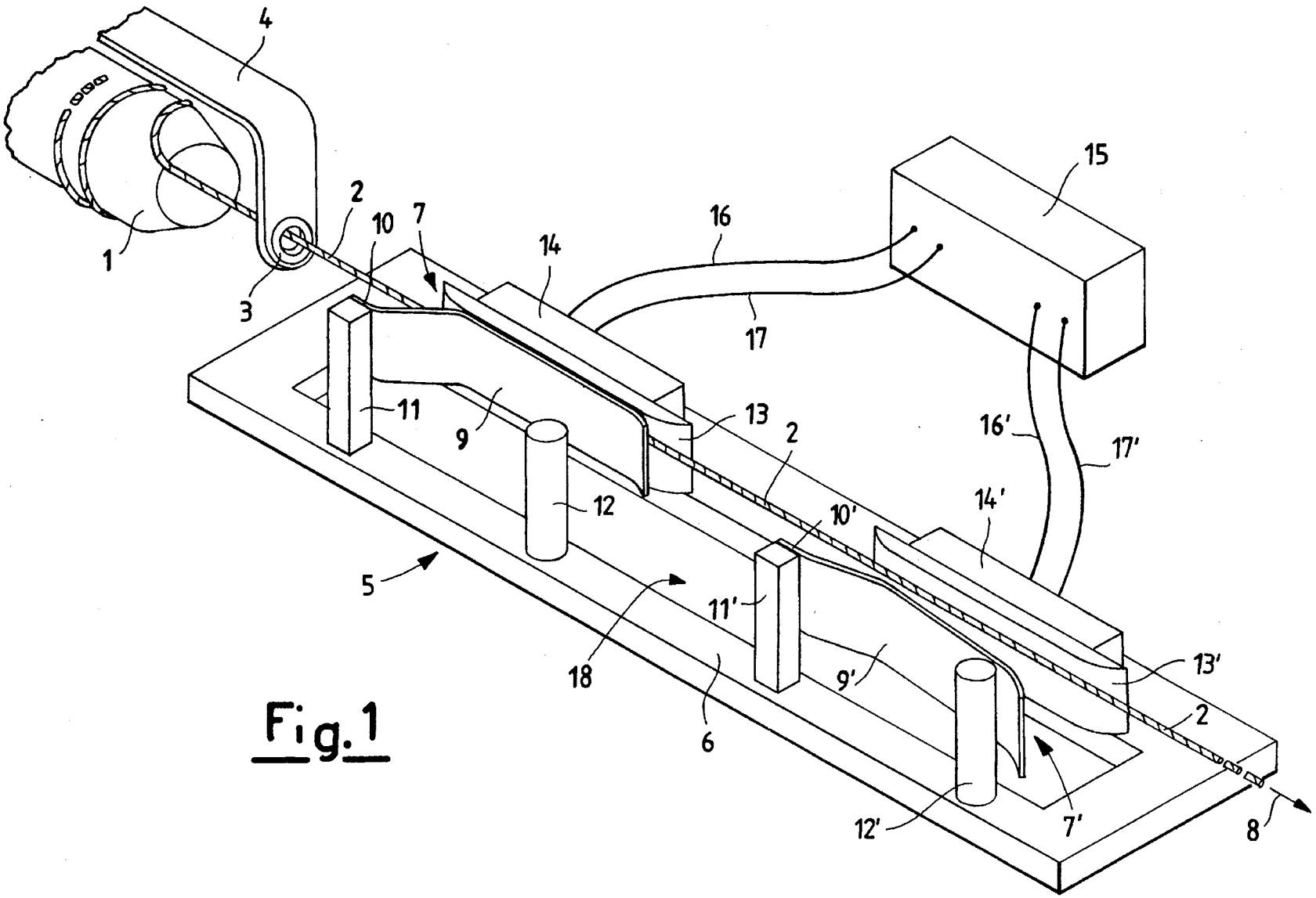
FIG. 1 is a perspective view of a weft brake formed in accordance with the present invention.
Figure 2:
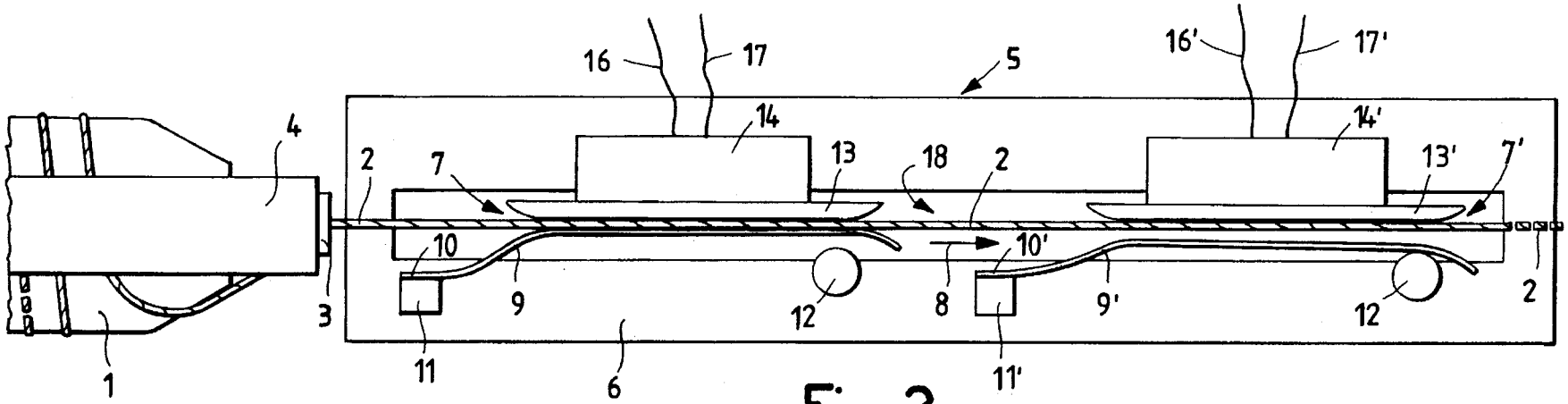
FIG. 2 is a top view of the weft brake of FIG. 1 taken from above.

In the figures reference numeral I indicates the feed bobbin for the weft yarn 2, which passes through the yarn guide ring 3 mounted on the support 4 and then through the weft brake 5 to reach the weft transporting members, not shown in the figures. Said weft brake 5 consists of a frame 6 on which two braking units, 7 and 7' respectively, are mounted in series in the weft travel direction 8.

Each unit 7, 7' comprises an elastic blade 9, 9', at least partly of magnetic material, which is arranged in a vertical position (see specifically FIG. 1) and is rigidly fixed by that, 10 and 10' respectively, of its ends closer to said feed bobbin 4 and hence lying at the entry of the weft yarn 2, to a column 11, 11' of adjustable angular position which, mounted rotatably on said frame 6, is rotated until the relative blade (see specifically the blade 9') presses against a stop pin ]2 mounted on said frame 6 at a position so as to cause the blade to assume a position distant from the weft yarn 2. Opposing said blade 9, 9' and beyond said weft yarn 2 there is provided a flat support plate 43, 43' of non-magnetic material, preferably glass or ceramic, which is mounted vertically on an electromagnet 14, 14', the excitation of which can be controlled by a logic unit ]5 via wires 16, 17 and 16', 17', respectively. Said weft yarn 2 travels between said blade 9, 9' and said plate 43, 13', said electromagnets 14, 14' being mounted on said frame 6 which comprises a central trash discharge slot 18, and are excited mutually out of phase by said logic unit 15 in order to attract and press said blade 9, 9' against said plate 13, 13', overcoming the preloading of the blade itself, to adequately brake the weft yarn 2.

Figure 3:
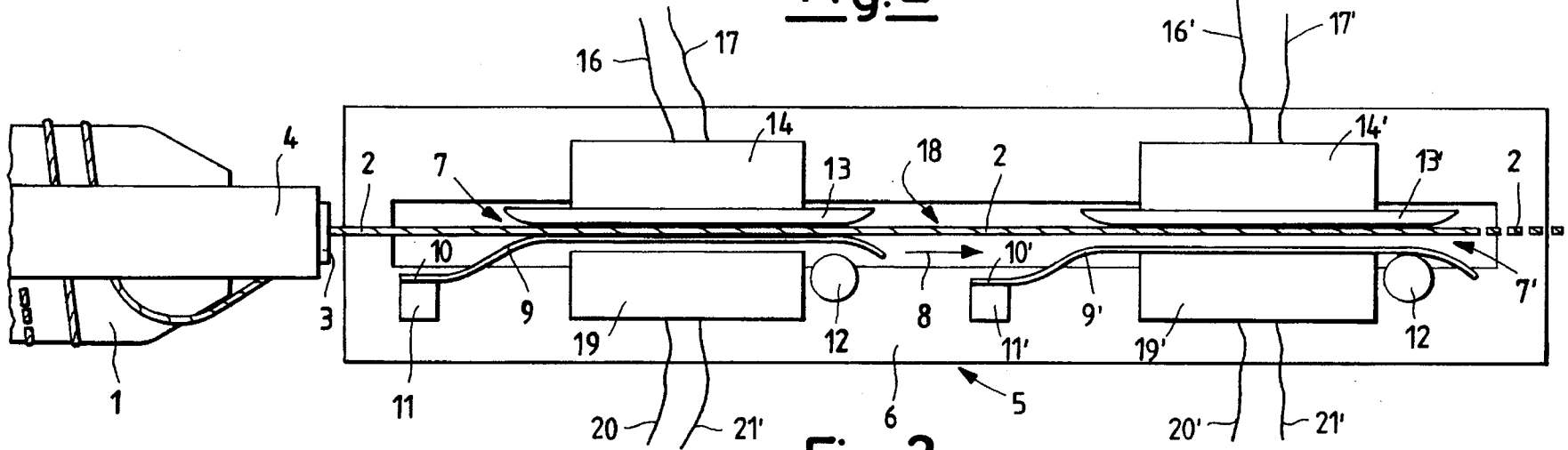
FIG. 3 is a view similar to that of FIG. 2, showing a modification according to the invention.

According to the modified embodiment of FIG. 3, a further electromagnet 49, 19' is mounted on said frame 6 in opposition to said electromagnet 14, 14', and is excited via wires 20, 21 and 20', 21' respectively by said logic unit 15 to accelerate the return of the blades 9, 9' against their stop pins 12 and to retain them thereat.

The weft brake is operated as follows.

During a loom weft insertion cycle the logic unit 15 appropriately excites the electromagnet 14 which attracts the blade 9, overcoming its preloading towards the support plate 13 and presses it against the weft 2 which is hence appropriately braked. At the same time, as the electromagnet 14' is de-energized, the blade 9' remains pressed against its stop pin 12 at a position distant from its support plate 13' so that the travelling weft yarn 2 can easily sweep away the trash present in the braking unit 7'.

During the next weft insertion cycle the excitation of the magnets is reversed so that the braking unit 7' brakes the weft yarn 2 while the braking unit 7 is being cleaned.

It is apparent that instead of corresponding to a whole loom weft insertion cycle, the phase displacement between the operation of the two braking units 7 and 7' can be a fraction or a multiple of said weft insertion cycle.

We claim:

1. A shuttleless loom weft brake, which comprises:

a plurality of braking units positioned on a frame of the weft brake in a weft yarn travel direction and including an elastic blade made at least partly of a ferromagnetic material, and a flat support plate of a non-magnetic material, between which said weft yarn originating from a feed bobbin travels wherein said blade is pressed against the plate by at least one electromagnet of adjustable excitation and wherein a stop pin is fixed to the frame for the weft brake of each braking unit;

said plurality of braking units comprises at least two braking units arranged in series on said weft brake frame in said weft yarn travel direction, the blades and support plates of said braking units being arranged in a vertical position, said blades being rigidly fixed to said frame of the weft brake at an end thereof which is closer to said feed bobbin and a column loaded on said frame, said column preloading each of the blades in a direction urging said blades away from the respective support plate thereof and against the respective stop pin thereof located on said frame.

2. A shuttleless loom weft brake as claimed in claim 1, wherein said support plates comprise glass.

3. A shuttleless loom weft brake as claimed in claim 1, wherein said support plates comprise ceramic.

4. A shuttleless loom weft brake as claimed in claim 1, wherein an additional electromagnet is mounted on said weft brake frame in opposition to said braking control electromagnet of adjustable excitation so as to facilitate withdrawal of each said blade from the support plate of each said blade against the stop pin of each said blade, respectively.

5. A shuttleless loom weft brake as claimed in claim 1, wherein said column comprises a column having adjustable angular positions.

* * * * *